US006056474A

United States Patent [19]

Nolan

[11] Patent Number: 6,056,474

[45] **Date of Patent: *May 2, 2000**

[54] HEIGHT CONTROL MECHANISM FOR STRIKE-OFF PLATE OF AN ASPHALT PAVER SCREED ASSEMBLY

[75] Inventor: David W. Nolan, University Place, Wash.

[73] Assignee: Caterpillar Inc., Peoria, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/087,519

[22] Filed: May 29, 1998

[51] Int. Cl.[7] ..... E01C 19/22

[52] U.S. Cl. ..... 404/118; 404/84.1

[58] Field of Search ..... 404/118, 84.1, 404/84.8, 96, 104

[56] References Cited

U.S. PATENT DOCUMENTS

| | | | |
|---|---|---|---|
| 1,330,531 | 2/1920 | Haynes | 404/84.1 |
| 1,388,690 | 8/1921 | Baker | 404/96 |
| 3,288,041 | 11/1966 | Layton | 94/46 |
| 4,272,213 | 6/1981 | McGovarin | 404/118 |
| 4,379,653 | 4/1983 | Brown | 404/118 |
| 4,688,965 | 8/1987 | Smith et al. | 404/75 |
| 4,702,642 | 10/1987 | Musil | 404/118 |
| 4,722,636 | 2/1988 | Brock | 404/84 |
| 5,203,642 | 4/1993 | Heller et al. | 404/118 |
| 5,215,404 | 6/1993 | Raymond | 404/118 |

*Primary Examiner*—Eileen Lillis
*Assistant Examiner*—Raymond W Addie
*Attorney, Agent, or Firm*—O. Gordon Pence; Steven G. Kibby

[57] ABSTRACT

A height control mechanism for a strike-off plate of an asphalt paver screed assembly is disclosed. The screed assembly is pivotally connected to a pair of tow arms of an asphalt paver and has at least one main screed unit and at least one screed extension unit mounted in front of the main screed unit. The screed extension is laterally movable beyond one end of the main screed unit. The screed assembly also has an adjustment mechanism for adjusting the pitch angle of the screeds relative to the ground. The height control mechanism includes a support mechanism adapted to mount the strike-off plate in front of the main screed unit at a position ahead of the screed extension unit. The height control mechanism also includes a linkage arrangement adapted to automatically control the height of the strike-off plate upon the adjustment of the pitch angle of the screeds.

6 Claims, 5 Drawing Sheets

HEIGHT CONTROL MECHANISM FOR STRIKE-OFF PLATE OF AN ASPHALT PAVER SCREED ASSEMBLY

TECHNICAL FIELD

The present invention relates generally to asphalt paver screeds and more particularly to a strike-off mechanism for leveling and controlling the amount of asphalt getting to the screeds.

BACKGROUND ART

Typical asphalt road paving machines (or asphalt pavers) have a hopper for receiving hot asphalt paving material located at the front and a conveyor for delivering the asphalt paving material from the hopper to the rear of the machine and depositing the asphalt at the back of the paver onto the road surface to be paved. An auger is located at the rear of the paver for distributing some of the asphalt material laterally to the sides of the road surface. The asphalt paver also includes a floating screed, which is pulled behind the auger, for smoothing out and compressing the asphalt to the desired road mat thickness. The screed unit is pulled behind the auger by a pair of tow arms, which have forward ends pivotally mounted to the sides of asphalt paver and rearward ends pivotally mounted to the screed.

Many modern screeds are provided with a pair of extendible screed units attached to a main screed unit. Each extendible screed unit is movable laterally to one side of the main screed unit in order to vary the width the road mat being laid down by the paver. Some of these extendible screed units are mounted behind the main screed unit, such as the ones shown in U.S. Pat. No. 5,203,642 issued Apr. 20, 1993 to John W. Heller et al. However, front mounted extendible screed units have become popular in recent years due to certain advantages they afford over rear mounted extendible screed units. One such screed with front mounted screed extension units is shown in U.S. Pat. No. 4,379,653, issued Apr. 12, 1983 to Robert L. Brown. Such patent also discloses the use of a strike-off plate positioned in front of the extension units to limit the amount of paving material between the side extension units during retraction.

Screeds are provided with screw adjustments for controlling the "pitch" or "angle of attack" of the screed surface relative to the desired final surface of the paving mat for controlling the depth of the mat being laid by the screed. For instance, if the angle of attack is increased by raising the leading edge of the screed sole plate, the depth of the mat formed by the screed is likewise increased. However as the angle of attack is increased, the height of the strike-off plate of prior screeds also increased. Because such strike-off plate is mounted at a substantial distance ahead of the main screed in front of the screed extensions, the rise in height of the strike-off plate is disproportionately greater than the increase in the mat height being formed by the screed. This results in too much asphalt material being fed to the main screed and an undesirable build-up between the screed extensions. As a consequence, the quantity of asphalt material becomes trapped between the screed extensions, which may prevent the full retraction of the screed extensions when a reduction in mat width is desired during paving operations. If the screed extensions cannot be retracted, the paver must be stopped and the excess asphalt material removed manually with shovels. This is not only time consuming and labor intensive, the stopping of the paver also creates undesirable inconsistencies and discontinuities in the compression of or other imperfections in the asphalt mat in as much as the floatation of the screed is affected by the speed of its forward movement.

DISCLOSURE OF THE INVENTION

The present invention relates to a height control mechanism for a strike-off plate of an asphalt paver screed assembly. The screed assembly is pivotally connected to a pair of tow arms of an asphalt paver and has at least one main screed unit and at least one screed extension unit mounted in front of the main screed unit. The screed extension is laterally movable beyond one end of the main screed unit. The screed assembly also has an adjustment mechanism for adjusting the pitch angle of the screeds relative to the ground. The height control mechanism includes a support mechanism adapted to mount the strike-off plate in front of the main screed unit at a position ahead of the screed extension unit. The height control mechanism includes a linkage arrangement adapted to automatically control the height of the strike-off plate upon the adjustment of the pitch angle of the screeds.

BEST MODE FOR CARRYING OUT THE INVENTION

Figure 1:
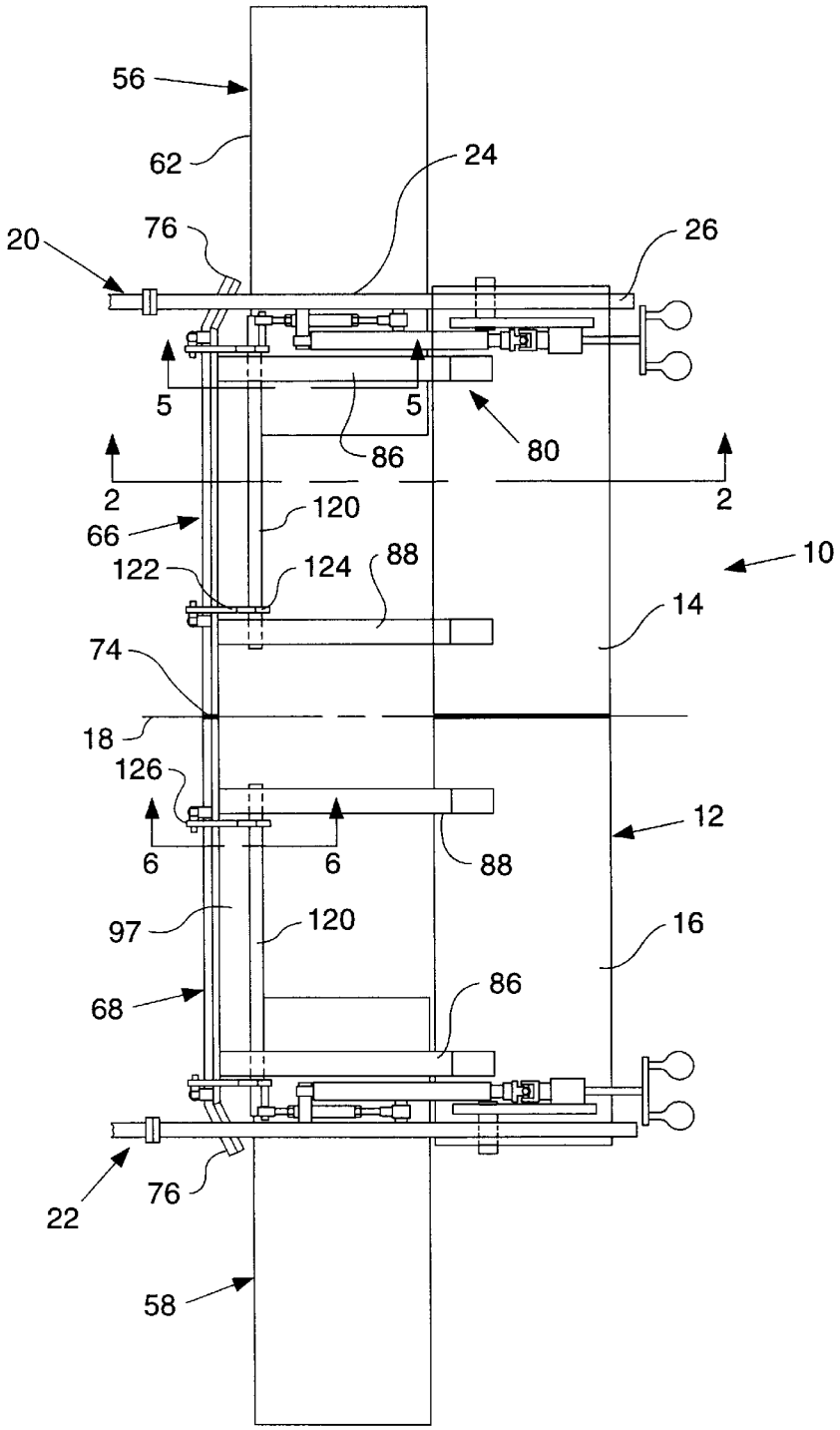
FIG. 1 is a diagramatic top plan view of a screed assembly embodying a height control mechanism constructed in accordance with the present invention.
Figure 2:
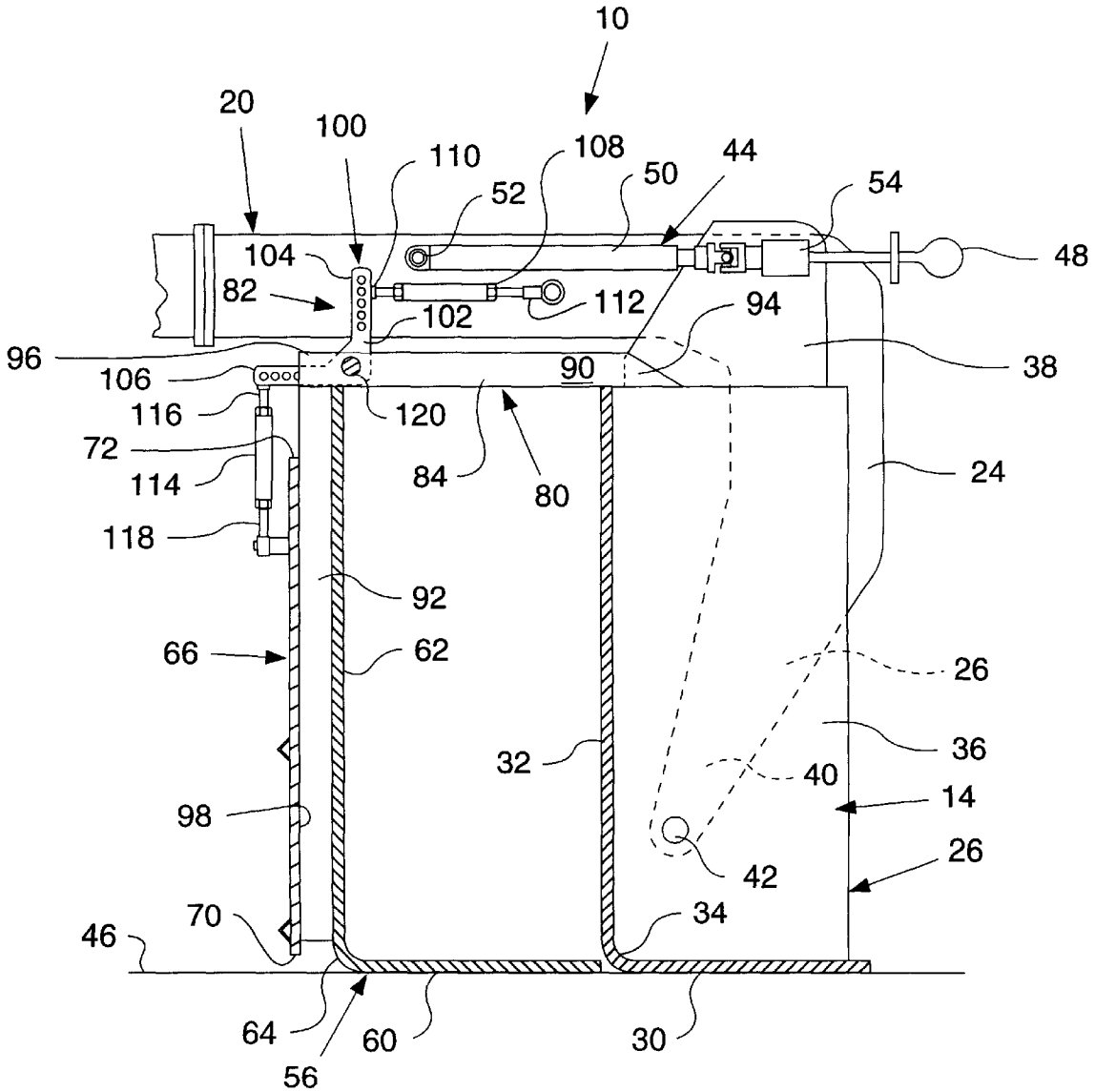
FIG. 2 is a diagramatic side cross-sectional view taken along line 2—2 of FIG. 1 illustrating the height control mechanism in more detail.

Referring now to FIG. 1 of the drawings, a top view of a floating screed assembly is diagramatically illustrated at 10 for an asphalt paving machine (not shown). The screed assembly includes at least one main screed section 12, which may be of more or less conventional construction. Preferably, as is customary in the art, the main screed section 12 includes a pair of main screed units 14,16 joined together about a centerline 18, which is oriented in the direction of travel and generally along the centerline of the paving machine. The main screed units 14,16 are joined together in a manner so as to be capable of being disposed at a slight angle with respect to each other for a crowning of the paved road surface about the centerline 18. The screed assembly is towed behind the asphalt paver by means of a pair of tow arms 20,22, each having a forward end thereof (not shown) pivotally connected to a respective side of the paving machine. Each tow arm 20,22 has a rearward end 24 having a drop arm portion 26, as best seen in FIG. 2.

The two main screed units 14,16 are, in general, mirror images of each other and only one will be further described and shown in the remaining drawings. As shown in FIG. 2 then, the right hand main screed unit 14 includes a frame structure 28 of a generally fabricated construction of steel plates, channels and gussets of any suitable configuration. In particular, screed unit 14 includes a bottom sole plate 30, a generally vertical front plate 32 joining with the sole plate at a rounded lower front corner 34. The screed unit 14 also includes an outer side plate 36 and a tower plate 38 secured adjacent and extending above the outer side plate 36. The tow arm drop arm portion 26 extends adjacent the tower plate and has a lower end 40 pivotally connected to the screed unit 14 by a pivot connection 42.

An adjustment mechanism 44 is provided for adjusting the pitch or attack angle of the screed assembly 10 relative to the ground, indicated at 46, in order to control the depth of the mat that is being set by the screed assembly 10. The adjustment mechanism 44 can be of any well known type. In the embodiment shown, the adjustment mechanism 44 includes hand crank 48 connected to a turnbuckle linkage 50. The turnbuckle linkage 50 has one end attached to the tow arm drop arm portion 26 by a suitable fastener at 52 and another end mounted to a bearing block 54 connected to the tower plate 38. By turning the hand crank 48 in one direction, the turnbuckle linkage is shortened from that shown in FIG. 2 to that shown in FIG. 3, which causes the screed assembly to pivot about the lower pivot connection 42, so as to increase the pitch angle of the sole plate 30 relative to the ground 46, as shown in an exaggerated form in FIG. 3 for illustrative purposes.

The screed assembly 10 also includes a pair of front mounted screed extensions 56,58, as shown in FIG. 1. Screed extensions 56,58 are also, in general, mirror images of each other and only one will be further described and shown in the remaining drawings. Then, as shown in FIG. 2, screed extension 56 includes a sole plate 60 and a front plate 62 joined by a rounded front corner 64. Each extension screed 56,58 is mounted to its respective main screed unit 14,16 and is selectively movable laterally from its extended position shown in FIG. 1 to a retracted position adjacent the centerline 18 in a manner well known in the art.

A pair of vertical strike-off plates 66, 68 extend across the length of the main screed units 14,16 at a position ahead of the screed extensions 56,58. Strike-off plates 66,68 have a bottom edge 70, a top edge 72 and inner and outer side edges 74,76. Each inner side edge 74 is disposed adjacent the other adjacent the centerline 18. Each strike-off plate 66,68 is provided with a length sufficient to have a respective one of its opposite outer side edges 76 overlap its respective screed extension 56,58 when such screed extensions are in their extended positions as shown in FIG. 1. Such outer side edges 76 are preferably angled toward the front plate 62 of its respective screed extension 56,58 for directing asphalt material toward the outer ends of the screed extensions.

In accordance with the present invention, a height control mechanism 78 includes a support mechanism 80 to mount the strike-off plates 66,68 in front of their respective main screed units 14,16 at a position ahead of the screed extensions 56,58. Support mechanism 80 preferably includes separate components for each main screed unit 14,16. As such components are also mirror images of the ones for the other, only one set of such components will be described herein, it being understood that a second set is included for the other main screed unit.

With this in mind the height control mechanism 78 also includes a linkage arrangement 82 adapted to automatically control the height of the strike-off plate 66, as shown in FIG. 2, upon the adjustment of the pitch angle of the screeds. In the embodiment shown, the support mechanism 80 includes a support arm mechanism 84. Preferably, support arm mechanism 84 includes a pair of laterally spaced L-shaped brackets 86,88, each bracket having a horizontal leg 90 and a vertical leg 92. The distal rearward end 94 of each horizontal leg 90 is attached to the main screed unit 14, while a forward proximal end 96 is disposed toward a respective one of the inner and outer side edges 74,76 of the strike-off plate 66. The vertical leg 92 extends downwardly from the forward proximal end 96 of the horizontal leg 90 and is disposed in a gap 97 (FIG. 1) between the front plate 62 of the screed extension 56 and strike-off plate 66 and adapted to provide support against a rear surface 98 of the strike-off plate.

Figure 4:
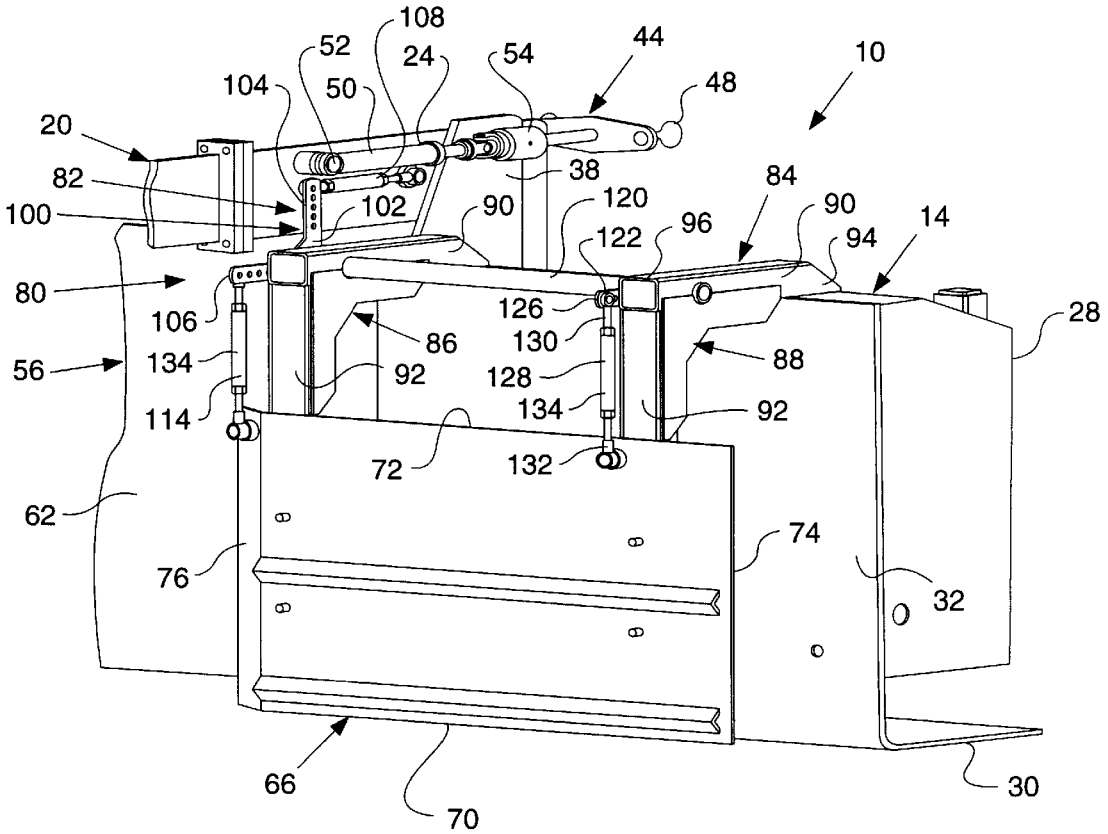
FIG. 4 is a fragmentary front perspective view of one-half of the screed assembly shown in FIG. 1: cross-sectional view taken along line 5—5 of FIG. 1.
Figure 5:
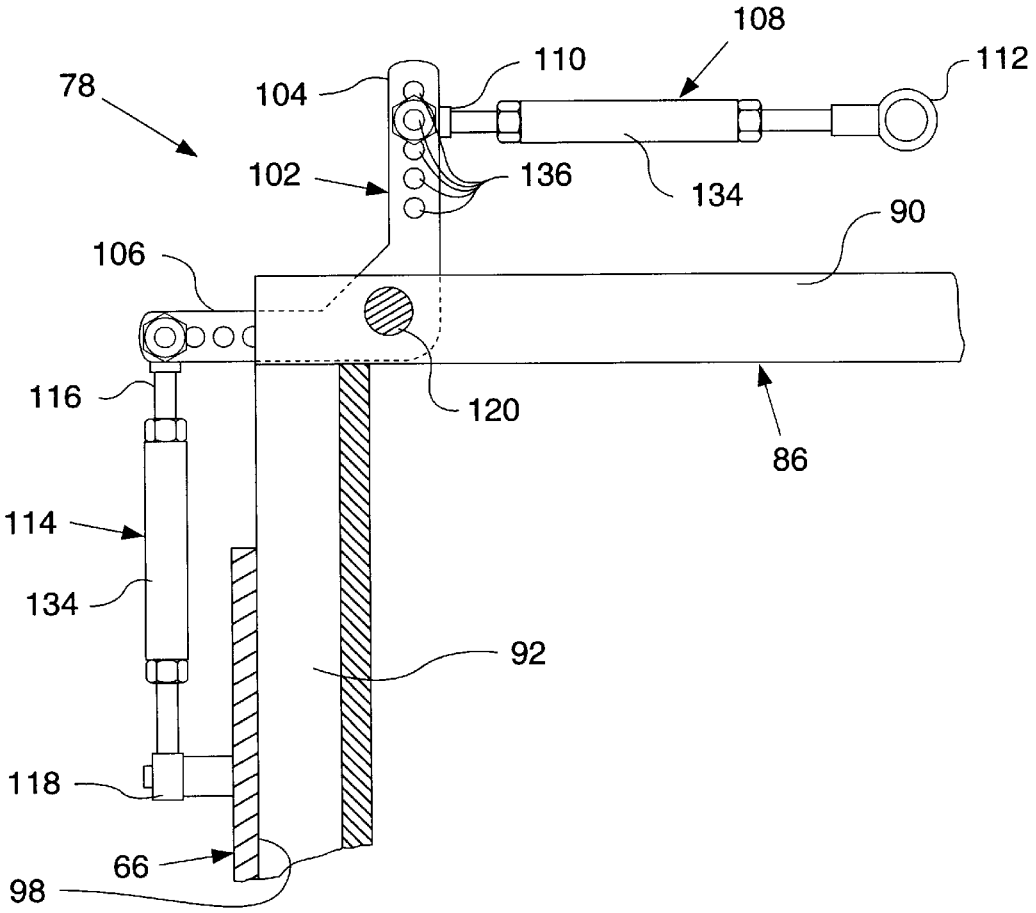
FIG. 5 is a fragmentary of one portion of the linkage mechanism of the present invention.

Each linkage arrangement 82 preferably includes a linkage mechanism 100 pivotally supported by the support arm mechanism 84. In particular, the linkage mechanism includes a bellcrank 102 having a first distal end 104 and a second distal end 106, a first connecting rod 108 having one end 110 pivotally connected to the first distal end 104 and its other end 112 pivotally connected to the tow arm 20 and a second connecting rod 114 having one end 116 pivotally connected to the second distal end 106 of the bellcrank 102 and its other end 118 connected to the strike-off plate 66. A pivot bar 120 is rotatably mounted to each of the horizontal legs 90 of the L-shaped brackets 86,88 adjacent their forward proximal ends 96. A lever 122 (FIGS. 4&6) has a proximal end 124 carried on the pivot bar 120 and a distal end 126 disposed adjacent the inner side edge 74 of the strike-off plate 66. A third connecting rod 128 has one end 130 pivotally mounted to distal end 126 of the lever 122 and its opposite end 132 connected to the strike-off plate 66 at a position closer to the inner side edge 74.

Figure 6:
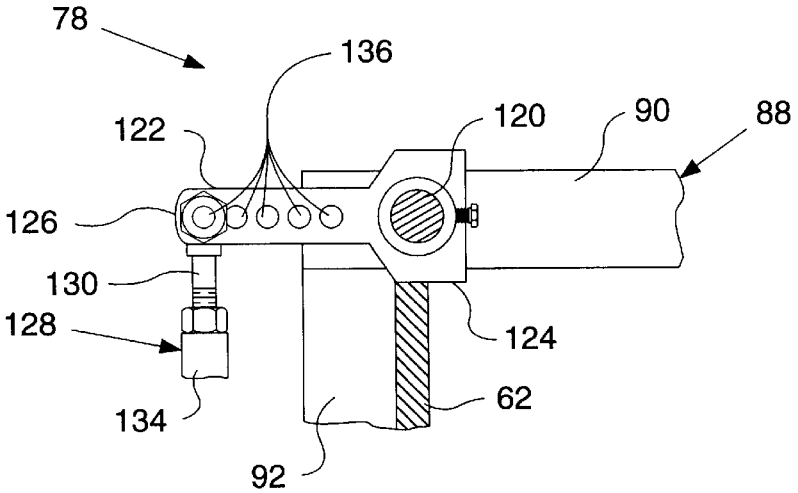
FIG. 6 is a fragmentary crossectional view taken along line 6—6 of FIG. 1: of another portion of the linkage mechanism of the present invention.

As shown in the drawings, at least one of the connecting rods, preferably first connecting rod 108, is constructed so that the length of the connecting rod can be adjusted. In particular though, all of the connecting rods 108, 114 and 128 are made length adjustable. This may be accomplished in any suitable manner, such as by including a turnbuckle 134 in each of such connecting rods such as shown in FIG. 6.

INDUSTRIAL APPLICABILITY

Figure 3:
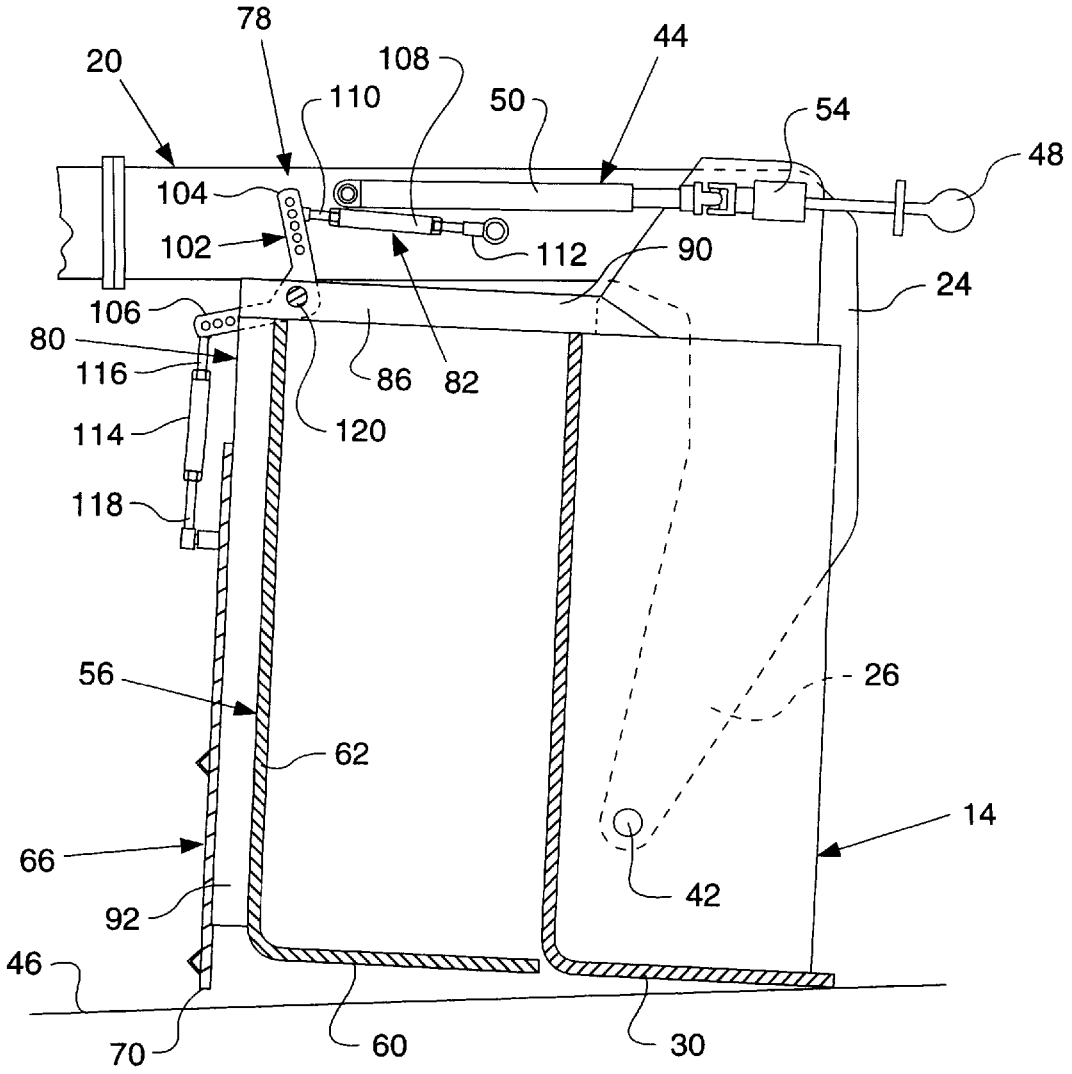
FIG. 3 is a diagramatic side cross-sectional view similar to FIG. 2, but with the pitch angle of the screed assembly being adjusted upwardly.

The construction of the height control mechanism 78 of the present invention is effective in mounting a strike-off plate 56,58 in front of each of the main screed units 14,16 of an asphalt paver screed assembly 10 and in automatically controlling the height of such strike-off plates upon adjustment of the pitch angle of the screed assembly 10. This is accomplished by a support mechanism 80 for supporting a linkage mechanism 82 from which the strike-off plates 66,68 are suspended. The support mechanism 80 utilizes a pair of L-shaped brackets 86,88 for rotatably mounting a transversely oriented pivot bar 120 having a bellcrank 102 connected to one end and a lever 122 connected to the other end of the bar. A second connecting rod 114 is connected to one end 106 of the bellcrank 102 for suspending one end of the strike-off plate 66, while a third connecting rod 128 is connected to the lever 122 for suspending the other end of the strike-off plate 66. The other end 104 of the bellcrank 102 is connected to an end 110 of first connecting rod 108, while the other end 112 is connected to the tow arm 20 of the asphalt paver. The arrangement and construction of the bellcrank 102 is such that when the screed assembly 10 pivots in a clockwise direction from a level position about pivot connection 42, as shown in FIG. 2, to a racked back position, as shown in FIG. 3, the bellcrank 102 rotates in a counterclockwise direction. Such counterclockwise rotation is effective in lowering the strike-off plates 66,68 relative to the sole plates 30, 60 of the main screed units 14,16 and the screed extensions 56,58.

As will be noted, each of the connecting rods 108,114,128 may be constructed with a turnbuckle 134 so as to be adjustable in length. By making the first connecting rod 108 adjustable, the entire of the strike-off plate relative the screeds may be adjusted to a desired height to let either more or less asphalt material pass under the strike-off plates. By having the second and third connecting rods 114,128 adjustable, the individual ends 74,76 of the strike-off plates may be raised or lowered as desired to accommodate different paving conditions and situations.

The primary advantage of the strike-off plate height control mechanism 10, though, is to automatically control the amount of asphalt material getting to the main screed units 14,16 between the screed extensions 56,58, regardless of whether the pitch angle of the sole plates 30,60 of the main screeds 14,16 and screed extensions 56,58, respectively, is zero or set at their maximum angle of attack. This is not to say, however, that the bottom edges 70 of the strike-off plates 66,68 are always maintained at the same distance above the ground line 46. In fact, it may be desirable to have the bottom edge 70 rise as the pitch angle of the sole plates is increased in that a increase in pitch angle increases the mat depth and more asphalt material will be required for this increase in mat depth. The lowering or lifting effect of the bellcrank 102 and lever 122 may be adjusted to readily accomplished this by connecting the connecting rods 108,114,128 in appropriate ones of the multiple attaching points 136 provided in the bellcrank 102 and lever 122.

Although the present invention has been described with reference to its preferred embodiment, workers skilled in the art will recognize that changes may be made in form and detail without departing from the spirit and scope of the invention.

I claim:

1. A height control mechanism for a strike-off plate of an asphalt paver screed assembly, said screed assembly being pivotally connected to a pair of tow arms of an asphalt paver and having at least one main screed unit and at least one screed extension unit mounted in front of said main screed unit and being laterally movable beyond one end of said main screed unit, and an adjustment mechanism for adjusting the pitch angle of the screeds relative to the ground, said height control mechanism comprising:

a support mechanism which mounts said strike-off plate in front of said main screed unit at a position ahead of said screed extension unit; and a linkage arrangement which automatically causes said support mechanism to lower the height of said strike-off plate responsive to operation of the adjustment mechanism increasing the pitch angle of said screeds.

2. The height control mechanism of claim 1 wherein said support mechanism includes:

a support arm mechanism carried on and extending forwardly from said main screed unit; and said linkage arrangement includes a linkage mechanism pivotally supported by said support arm mechanism, said linkage mechanism including a bellcrank having a first distal end and a second distal end, a first connecting rod having one end pivotally connected to said first distal end and its other end pivotally connected to said tow arm and a second connecting rod having one end pivotally connected to the second distal end of said bellcrank and its other end connected to said strike-off plate.

3. The height control mechanism of claim 2 wherein said strike-off plate includes a bottom edge, a top edge and inner and outer side edge portions, and wherein said support arm mechanism includes a pair of laterally spaced arms, each arm having a distal end adjacent a respective one of the inner and outer side edge portions of said strike-off plate.

4. The height control mechanism of claim 3 wherein said linkage mechanism includes a pivot bar rotatably mounted to each of said support arms adjacent their distal ends, said bellcrank being carried at one end of said pivot bar and having a lever with a proximal end carried at the other end of said pivot bar and a distal end adjacent the inner end portion of said strike-off plate, and a third connecting rod having one end pivotally mounted to said lever and its opposite end connected to said strike-off plate.

5. The height control mechanism of claim 4 wherein at least one of said connecting rods are length adjustable.

6. The height control mechanism of claim 5 wherein all of said connecting rods are length adjustable.

* * * * *